US005822946A

United States Patent [19]

Rasmussen

[11] Patent Number: 5,822,946

[45] Date of Patent: Oct. 20, 1998

[54] SPACING MEMBER

[76] Inventor: Henning Baltzer Rasmussen, Danasallé 11, DK-8700 Horsens, Denmark

[21] Appl. No.: 765,097

[22] PCT Filed: Jun. 30, 1995

[86] PCT No.: PCT/DK95/00282

§ 371 Date: Dec. 20, 1996

§ 102(e) Date: Dec. 20, 1996

[87] PCT Pub. No.: WO96/00825

PCT Pub. Date: Jan. 11, 1996

[30] Foreign Application Priority Data

Jun. 30, 1994 [DK] Denmark ..... 0779/94

[51] Int. Cl.[6] ..... E04C 5/16

[52] U.S. Cl. ..... 52/68.1; 52/677; 248/87

[58] Field of Search ..... 52/677, 678, 685–687; 248/74.1, 74.3, 74.4, 505

[56] References Cited

U.S. PATENT DOCUMENTS

| | | | |
|---|---|---|---|
| 3,387,423 | 6/1968 | Andersson . | |
| 3,673,753 | 7/1972 | Anderson | 52/685 |
| 3,693,310 | 9/1972 | Middleton | 52/685 |
| 3,745,737 | 7/1973 | Kemer et al. | 52/687 |
| 3,830,032 | 8/1974 | Robb . | |
| 4,060,954 | 12/1977 | Liuzza | 52/677 |
| 4,498,270 | 2/1985 | Ilukowicz | 52/685 |
| 4,655,023 | 4/1987 | Yung . | |
| 4,831,803 | 5/1989 | Leonardis | 52/687 X |
| 4,835,933 | 6/1989 | Yung | 52/687 X |
| 4,928,472 | 5/1990 | Chang | 52/687 X |
| 5,014,485 | 5/1991 | Chang | 52/687 X |
| 5,107,654 | 4/1992 | Leonardis . | |

FOREIGN PATENT DOCUMENTS

| | | | |
|---|---|---|---|
| 130933 | 5/1975 | Denmark . | |
| 1913104 | 10/1969 | Germany . | |
| 1484994 | 4/1971 | Germany . | |
| 431000 | 8/1967 | Switzerland . | |
| 2206619 | 1/1989 | United Kingdom . | |
| 9001600 | 2/1990 | WIPO | 52/685 |

*Primary Examiner*—Christopher Kent
*Assistant Examiner*—Yvonne Horton-Richardson
*Attorney, Agent, or Firm*—Watson Cole Grindle Watson, P.L.L.C.

[57] ABSTRACT

A spacing member for chocking reinforcement wires in a certain level from the outside of a finished cast structure. The spacing member comprises a first spacing chock (1), a second spacing chock (21) and locking clips (14, 42). Reinforcement wires are placed in supporting surfaces (7, 8, 9, 10, 24, 25, 26, 27) in the spacing chocks (1, 21) and, by using several different spacing chocks, it is possible to place reinforcement wires in several different levels. In particular, the combination of the first and the second spacing chock provides the possibility of placing several crossing reinforcement wires in several levels.

13 Claims, 6 Drawing Sheets

SPACING MEMBER

DESCRIPTION

The present invention relates to a spacing member for chocking reinforcement wires. said spacing member comprising a first spacing chock provided with feet for placement on a base for casting and support surfaces for the reinforcement wires wherein the feet are provided by the ends of at least four columns interconnected by a central part which is provided between the ends of the columns and which defines, between the columns, support surfaces in different distances from the column ends In order to position reinforcement wires in cast building structures, it is necessary to fix the reinforcement wires in relation to the total cast structure. For example this may be done by placing the reinforcement wires in spacing members designed for that purpose and positioned initially before casting and in which the reinforcement wires are also placed before the casting is done. The spacing members are usually constructed as modules in the shape of chocks.

Simpler spacing members of this type are known, e.g. from GB-A-2,206,619, which are produced from plastic and which only permit placing reinforcement wires in one or two heights from the base of the casting. Spacing members of plastic have the disadvantage that it is difficult to embed the plastic members e.g. in concrete because those two materials are very little congruent.

A spacing member is known from U.S. Pat. No. 3,387,423, which is of the type mentioned by way of introduction. A spacing member of this type comprises four columns interconnected by a central part. The spacing member could be placed on either side or at the end of the columns, thereby defining a support surface in different distances from a base upon which the spacing member is arranged. This spacing member requires a binding wire to interconnect the reinforcement wire and the spacing member. Moreover, the spacing member of this type is arranged for supporting only one reinforcement wire.

In certain types there is a high risk of formation of hollows in the concrete, which causes a risk of water penetration or formation of condensate with a consequent risk of corrosion on the reinforcement. This contributes to heavy weakening of the concrete structure.

Spacing members of concrete are also known which have a design, however, that involves various disadvantages. Firstly, it is necessary to use binding wire in order to fasten the reinforcement wires to the spacing members. In order to avoid the risk of any possible deterioration of the appearance of the finished structure, a second requirement is that the casting moulds have to be vacuumed in order to remove any remainders of cut binding wire. This prevents the formation of corrosion near the surface of the finished structure. Thirdly, the constructions used for known members are inappropriate since it is very difficult to make a complete casting all around the members, and it is particularly difficult to make a casting under the members.

Finally, with the known members there are limited possibilities of varying the support level of the reinforcement wires. The most common levels of support for the reinforcement wires from the bottom or the sides of the concrete structure are the distances of 25, 30, 35, 40 and 50 mm. Using known members, it is often necessary to possess several different members each of which provides one of these desired heights.

Spacing members are also known which partly solve these problems and which are of the type mentioned in the introduction. An example among others of such a spacing member is known from the German publication No. 1,484,994. Such a spacing member is designed for placement of reinforcement wires in different levels depending on the support surfaces used. This spacing member is disadvantageous, however, since it may only be used for laying wires horizontally and only for laying reinforcement wires in one level. Furthermore, the reinforcement wires will lie loosely on the spacing member.

Spacing members are also known in which the wires may be fastened since the spacing member is set up with undercut grooves for receiving the spacing members. Such members, which are produced from plastic, are undesirable in many concrete structures, however. An example of such a spacing member is known from German publication No. 1,913,104.

Thus, it is the object of the present invention to provide a spacing member for reinforcement wires for embedding in a cast structure which makes it possible by means of few and inexpensive elements to support and fasten the reinforcement wires in different levels at the same time as the finished structure is not weakened because of problems related to casting around, and particularly under, the spacing member.

This object is achieved by a spacing member which is characterized by a locking clip for mutually securing the reinforcement wire and the spacing member and being constituted by an elastic thread with a substantially U-shaped course with extensions of the U branches which extend in a first section towards the opposite branch and then, in a second section, extend in substantially parallel direction towards the bottom of the U, in that diametrically opposite grooves for receiving the U branches are provided in the first spacing chock, and in that at least one projection for cooperating with an undulation of the U branches is formed in said grooves.

A spacing member according to the present invention is advantageous by permitting the support and fastening of reinforcement wires in several levels by use of the same member. This is achieved by a spacing member construction which provides the possibility of using different levels by turning the member in different directions with support surfaces which are provided in grooves in the spacing member. The grooves are formed between the columns of the first spacing chock. Moreover, the locking clip will ensure the fastening of the reinforcement wire in correct contact with the groove so that the level in which the reinforcement wire is to be situated in the finished structure will be kept.

It is important that the locking clip is mounted in the spacing member in such a manner that there will be no possibility of unintended loosening of the locking clip from the spacing member, even when during the final casting of the structure concrete is let down over the assembly consisting of spacing chocks, reinforcement wires and locking clips. Therefore, the locking clip is mounted in a groove which is provided in the columns of the first spacing chock or in the cylindrical sleeve of the second spacing chock. A projection formed in these grooves cooperates with the locking clip to ensure that the locking clip will not slide out of the groove. Alternatively, the locking clip may be retained in wedge-shaped grooves.

The groove is preferably positioned so that the locking clip is always positioned at an acute angle in relation to a reinforcement wire. In a particularly preferred embodiment the grooves will be positioned in such a manner that the locking clip forms a 45° angle with the reinforcement wires. The locking clip may then be used for simultaneous securing of two crossing reinforcement wires which are placed in a mutually crossing position in a spacing chock. Due to the U-shape and the orientation of the extensions, the other sections of the extensions will always be pressed against reinforcement wires in a direction of force directed downwards to the bottoms of the grooves. Thus, it will be ensured that the wires are retained in the groove. Moreover, crossing wires will be retained by the other sections of the extensions since these other sections will be pressed inward in the corner area between the crossing reinforcement wires. In this manner both reinforcement wires are secured in a safe manner.

In a particular embodiment the spacing member is designed with a second spacing chock which has feet constituted of a substantially plane circular plate. This embodiment is particularly suitable for use in situations where the spacing member is to rest on a little solid base such as mineral wool insulation. The second spacing chock is also designed to cooperate with a locking clip.

In order to obtain sufficient casting around, and in particular a sufficient casting under the spacing member, its design has been made such that there may be an unhampered flow of concrete around and through the spacing member. In a preferred embodiment this is obtained in that the central part of the first spacing chock is formed as an arch. A through-going hole is formed in the middle area of the central part. Concrete which is cast around the first spacing chock and which spreads around the spacing chock, is led inwards to the central part along the arch and further down under the spacing chock through the through-going hole in the middle area. The through-going hole also ensures that air is not confined under the arch.

With every first spacing chock it is possible to provide four different levels in which the reinforcement wires may be put. It will also be possible, however, to increase the number of levels in which the reinforcement wires may be put by producing first spacing chocks with columns having different sizes. For different first spacing chocks it will further be possible to modify the distance between the columns in order to have the possibility of placing reinforcement wires with different diameters.

In order to obtain a high degree of variability in placing reinforcement wires in different levels, it is further possible to use a first and a second spacing chock the designs of which have been made such that they may cooperate to receive reinforcement wires in several different levels. For certain combinations of co-operation between the first and the second spacing member one further obtains the advantage that several reinforcement wires may be received at the same time in several different levels.

The spacing member according to the present invention may be produced from various materials. However, the spacing member will preferably be produced from fibrous concrete. Using this material for the production of the spacing member, one obtains several advantages. The fibrous concrete has primarily high strength in relation to the mass of the material. This means that relatively slender spacing members may be produced which possess sufficient strength to be used in a cast structure.

Besides, the fibrous concrete is more congruent with the concrete subsequently used for completing the casting of the structure in question in which the spacing member is used. The risks of hollows and corrosion are thus considerably reduced in relation to previous applications of spacing chocks in plastic and concrete.

Furthermore, it is very inexpensive to produce spacing members from fibrous concrete. Advantageously, the fibrous concrete is cast in a closed mould. The mould is simple and may be produced from simple materials such as PVC or styrene plastic. The hardening of the spacing member produced from fibrous concrete lasts about 14 days and in this period the spacing member is contained in the mould. This results in faster hardening of the fibrous concrete, and the spacing member may be shipped even before the fibrous concrete has completed hardening since the mould will protect the spacing member during shipment.

DESCRIPTION OF THE DRAWING

The invention will now be described in further detail with reference to the attached drawings, in which.

DETAILED DESCRIPTION OF THE DRAWING

Figure 1:
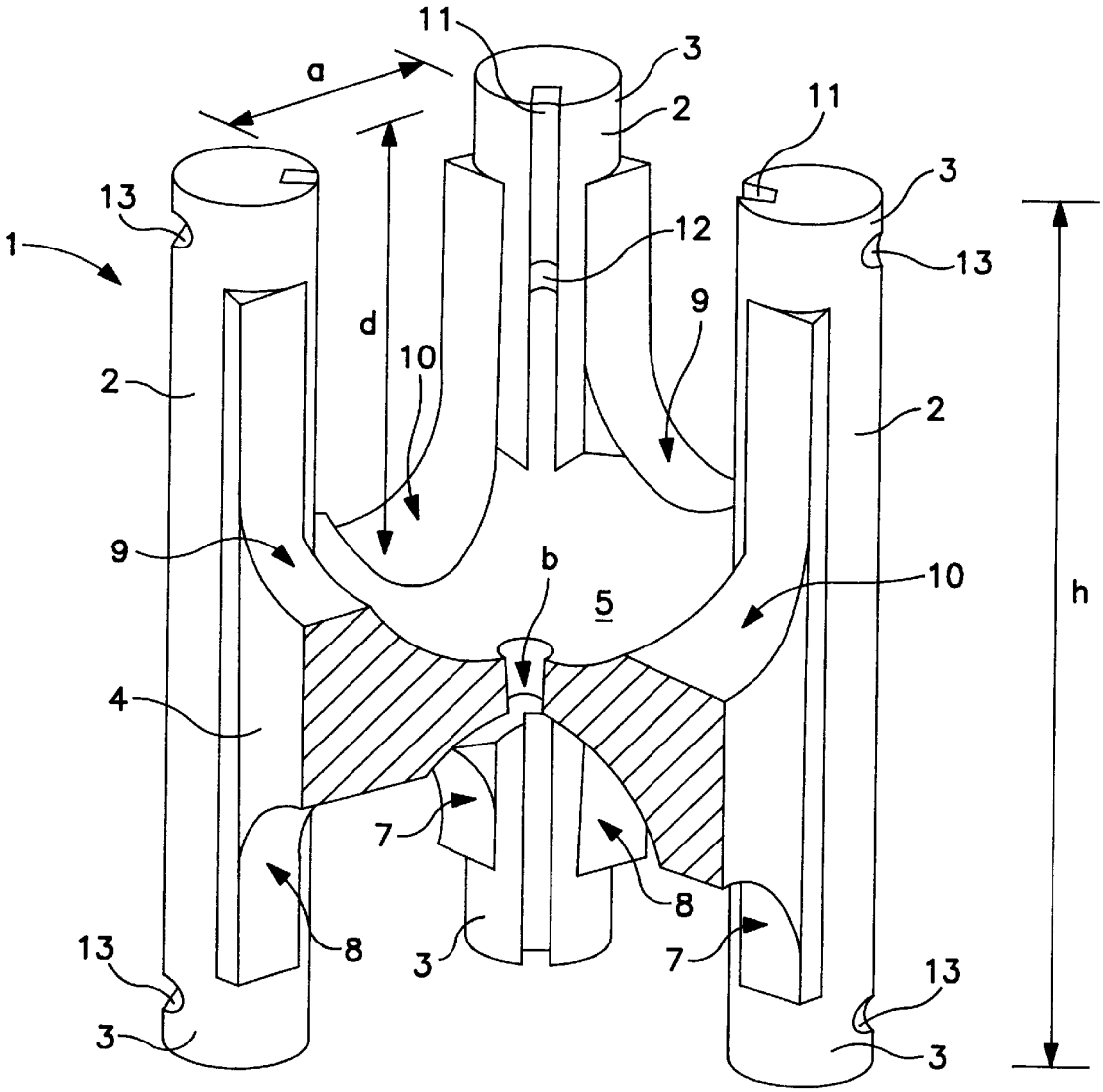
FIG. 1 is a perspective, partially sectional view of a first spacing chock for a spacing member according to the invention.

FIG. 1 illustrates a first spacing chock 1 for a spacing member according to the invention. The spacing member consists of four columns 2, only three columns of which are shown since the spacing member is shown in a sectional view. Each of the columns 2 has two feet 3, and the columns are interconnected by a central part 4.

The central part 4 consists of a middle area 5 having the shape of an arch and with a through-going hole 6, and pairs of opposite support surfaces 7, 8, 9, 10, the support surfaces 7 and 8 being shown only partially. The support surfaces extend between pairs of columns 2. The depths d of the support surfaces as measured from the end surfaces of the feet 3 of the columns differ. There is a total of eight support surfaces 7, 8, 9 10, and these are equally deep in pairs so that support surfaces situated opposite each other in relation to the middle area 5 of the central part 4 are equally deep. The support surfaces 7 are the least deep ones, and the support surfaces 8, the support surfaces 9 and the support surfaces 10 are increasingly deep, the support surfaces 10 being the deepest ones. A distance a between the columns 2 determines the maximum diameter that reinforcement wires to be placed in the spacing chock may possess. The distance a may differ in different spacing chocks.

Reinforcement wires (not shown) may be placed in the support surfaces 7, 8, 9, 10 in such a manner that the reinforcement wires extend between one pair of opposite equally deep support surfaces. By rotating or turning the spacing chock 1, it is possible to place a reinforcement wire extending in a given direction in different levels. The levels in which a reinforcement wire may be placed depend on the height h of the columns and of the depth d of the support surfaces 7, 8, 9 10.

In order to ensure that the reinforcement wire will not be displaced out of the support surfaces 7, 8, 9, 10, the reinforcement wire is secured to the spacing chock 1 with a locking clip (see FIG. 2). The locking clip is inserted in grooves 11 provided along the inside of the columns 2 turning towards the middle area 5 of the central part 4. In the grooves 11 there are provided projections 12 designed to cooperate with an undulating shape of the locking clips (see FIG. 2).

Notches 13 are formed along the outside of the columns 2 at the column feet 3 in either end of the columns. The notches 13 are designed to cooperate with catches in a second spacing chock of a spacing member according to the invention (see FIG. 3).

The first spacing member illustrated in FIG. 1 may be designed with columns 2 having different heights h and having different distances a between the columns. In a preferred embodiment there are disclosed a small embodiment of a first spacing member and a large embodiment of a first spacing member. The small embodiment has columns 2 with a smaller height h and a shorter distance a between the columns compared to the large embodiment.

Figure 2A:
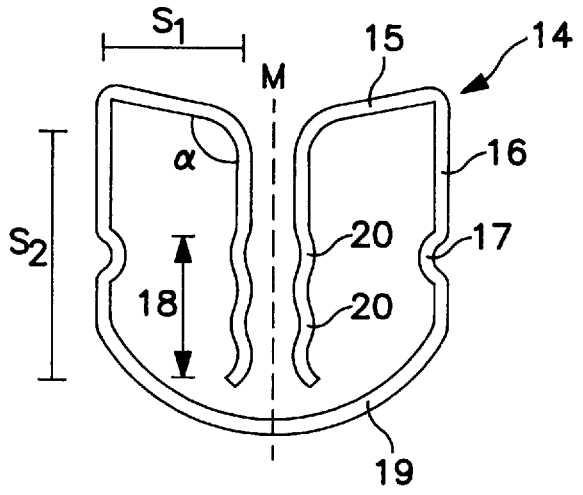
FIGS. 2A–2B are plane views of an embodiment of a locking clip for use in combination with the first spacing chock.
Figure 2B:
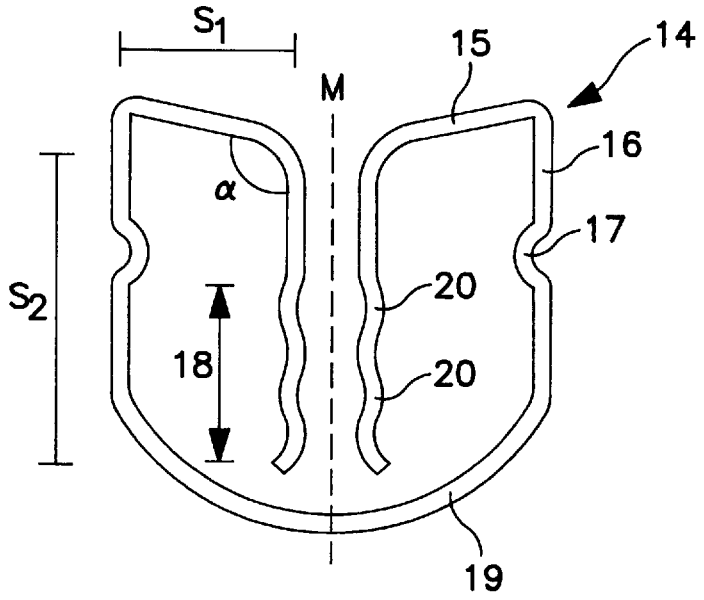

FIGS. 2A and 2B illustrate embodiments of a locking clip 14 according to the invention. The locking clip 14 illustrated in FIG. 2A is designed for use in combination with the small embodiment of a first spacing chock described in FIG. 1, and the locking clip 14 illustrated in FIG. 2B is intended for use in combination with the large embodiment of a first spacing chock.

The locking clip 14 is produced from a piece of round thread, preferably of stainless steel, but it may also be of a different metal or of plastic. The thread is bent in such a manner that the locking clip 14 has a U-shape. Two extensions 15 extend in pairs from the U branches 16 and extend in a first section $S_1$ towards the opposite U branch 16. Before the extensions reach the middle M of the U, the extensions 15 turn off in an angle $\alpha$ and subsequently extend in a second section $S_2$ substantially parallel with each other towards the bottom 19 of the U.

The locking clip 14 is provided, along one outer side of the U branches, with an undulation 17. The undulation 17 is designed to enter into contact with the corresponding projection 12 (see FIG. 1) which is formed in the grooves 11 in the columns 2 of the spacing chock 1. In the section $S_1$ of the extensions 15 which extends towards the bottom 19 of the U, the locking clip 14 is further provided with a corrugation 18. The corrugation comprises two undulations 20 designed to receive the reinforcement wire in the level in relation to the support surfaces 7, 8, 9, 10 of the spacing chock (see FIG. 1) in which the reinforcement wire is positioned.

Figure 3:
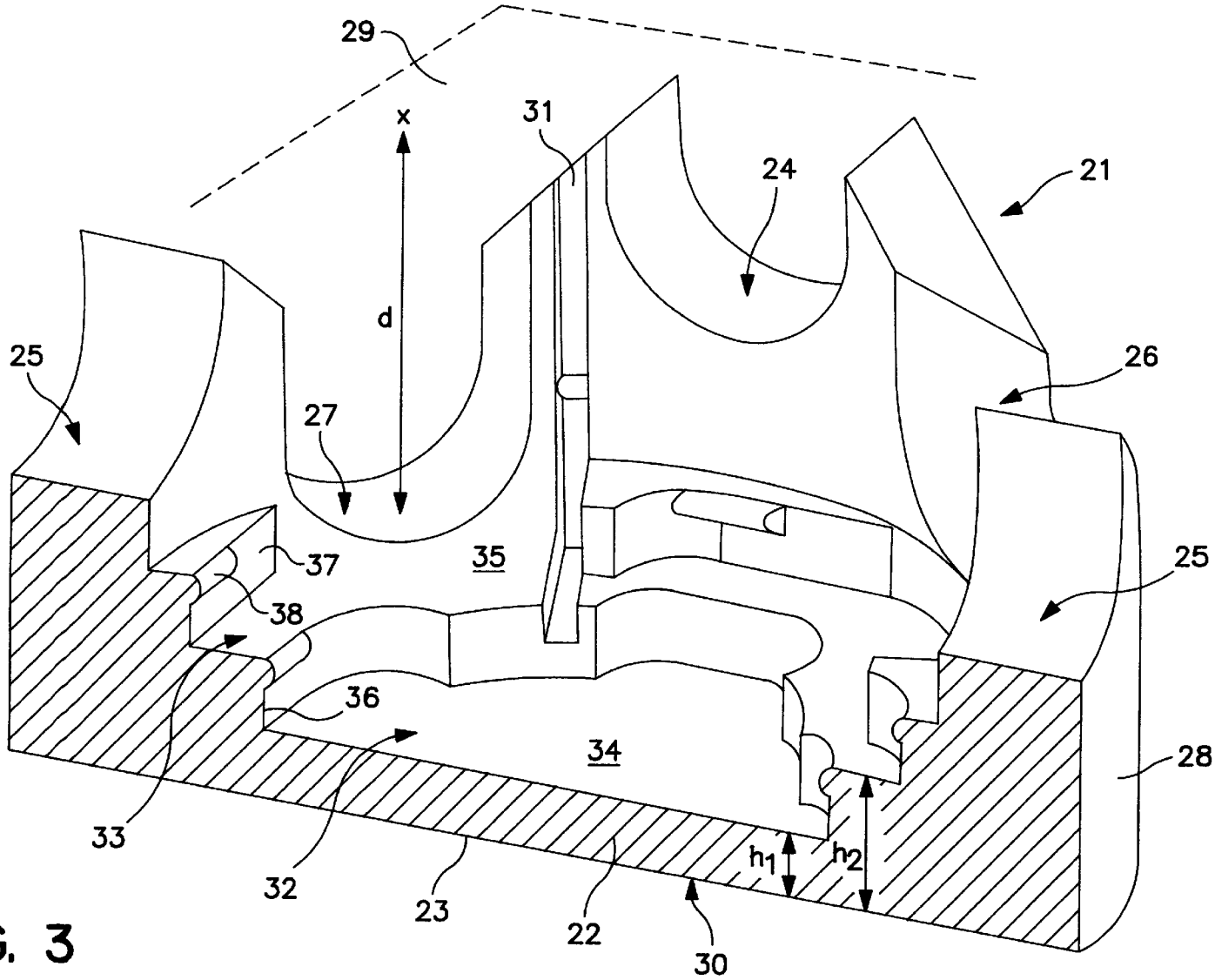
FIG. 3 is a perspective view of a section of a second spacing chock for a spacing member according to the invention.

FIG. 3 illustrates a second spacing chock 21 for a spacing member according to the invention. This second spacing chock is designed in such a manner that it may optionally be used separately or be used in combination with the small or the large embodiment of the first spacing chock 1.

Unlike the first spacing chock 1, the second spacing chock 21 is provided with columns but with a substantially circular plate 22 constituting a foot 23 of the spacing chock 21. The plate 22 is particularly well suited for placement of the spacing chock 21 on bases with reduced carrying capacity such as mineral wool bats or styropor.

The spacing chock 21 is equipped with support surfaces 24, 25, 26, 27 which are provided in a cylindrical sleeve 28. The depths d of the support surfaces 24, 25, 26 27 as measured from a fictitious upper plane 29 over the spacing chock and parallel with an end bottom 30 of the plate 22 are different like in the first spacing chock. In the second spacing chock there are provided eight support surfaces which are equally deep in pairs. The support surfaces 24 are the least deep ones and the support surfaces 25, the support surfaces 26 and the support surfaces 27 are increasingly deep, the support surfaces 27 being the deepest ones.

Reinforcement wires (not shown) may be placed in the support surfaces 24, 25, 26, 27 in such a manner that, like in the first spacing chock, the reinforcement wire extends through a pair of opposite equally deep support surfaces. By rotating the spacing 21 it is possible to place a reinforcement wire extending in a given direction in different levels.

A groove 31 designed to receive a locking clip (see FIG. 4) is provided between the support surfaces 24, 27. As the support surfaces 24, 25, 26, 27 are positioned more closely in the second spacing chock 21, namely at intervals of 45° rather than intervals of 90°, grooves 31 for each position of reinforcement wires in the support surfaces are not provided. Thus, the locking clip which is placed in the grooves 31 will have to secure reinforcement wires for different positions of the reinforcement wires in the support surfaces.

Two grooves 32, 33 are provided in the plate 22. A first groove 32 with a surface 34 located in a first height $h_1$ over the end surface 30 of the plate 22, and a second groove 33 with a surface 35 located in a second height $h_2$ over the end surface 30 of the plate 22. The two grooves 32, 33 are used when the second spacing chock 21 is made to cooperate with the small or the large embodiment of the first spacing chock 1. The first groove 32 forms a support surface for the columns 2 in the small embodiment of the first spacing chock 1, whereas the second groove 33 forms a support surface for the large embodiment of the first spacing chock 1. Along an edge area 36, 37 of the first groove 32 and the second groove 33, respectively, there are catches 38 designed to contact notches 13 in the outer side of the columns 2 of the first spacing chock 1.

Figure 4:
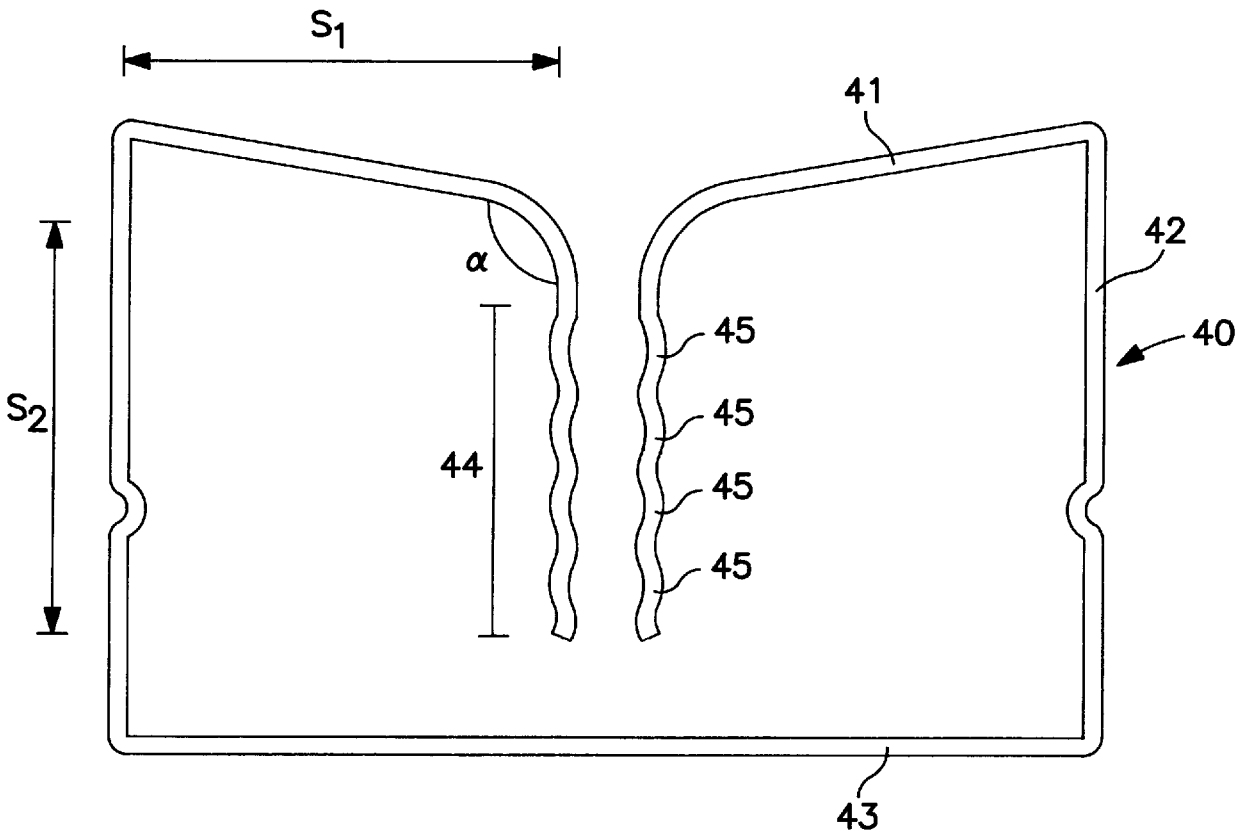
FIG. 4 is a plane view of an embodiment of a locking clip for use in combination with the second spacing chock.

FIG. 4 illustrates a locking clip 40 for use in connection with the second spacing chock 21. The locking clip is designed substantially like the locking clip 14 used in combination with the first spacing chock 1 (see FIG. 2). The locking clip 40 used in combination with the second spacing chock 21 has a different U-shape, however, and the extensions 41 extending from the U branches 42 are provided with a corrugation 44 with four undulations 45 along the section $S_2$ extending towards the bottom 43 of the U. This is because the second spacing chock 21 is equipped with support surfaces 24, 25, 26, 27 for placement of reinforcement wires in four different levels.

Figure 5:
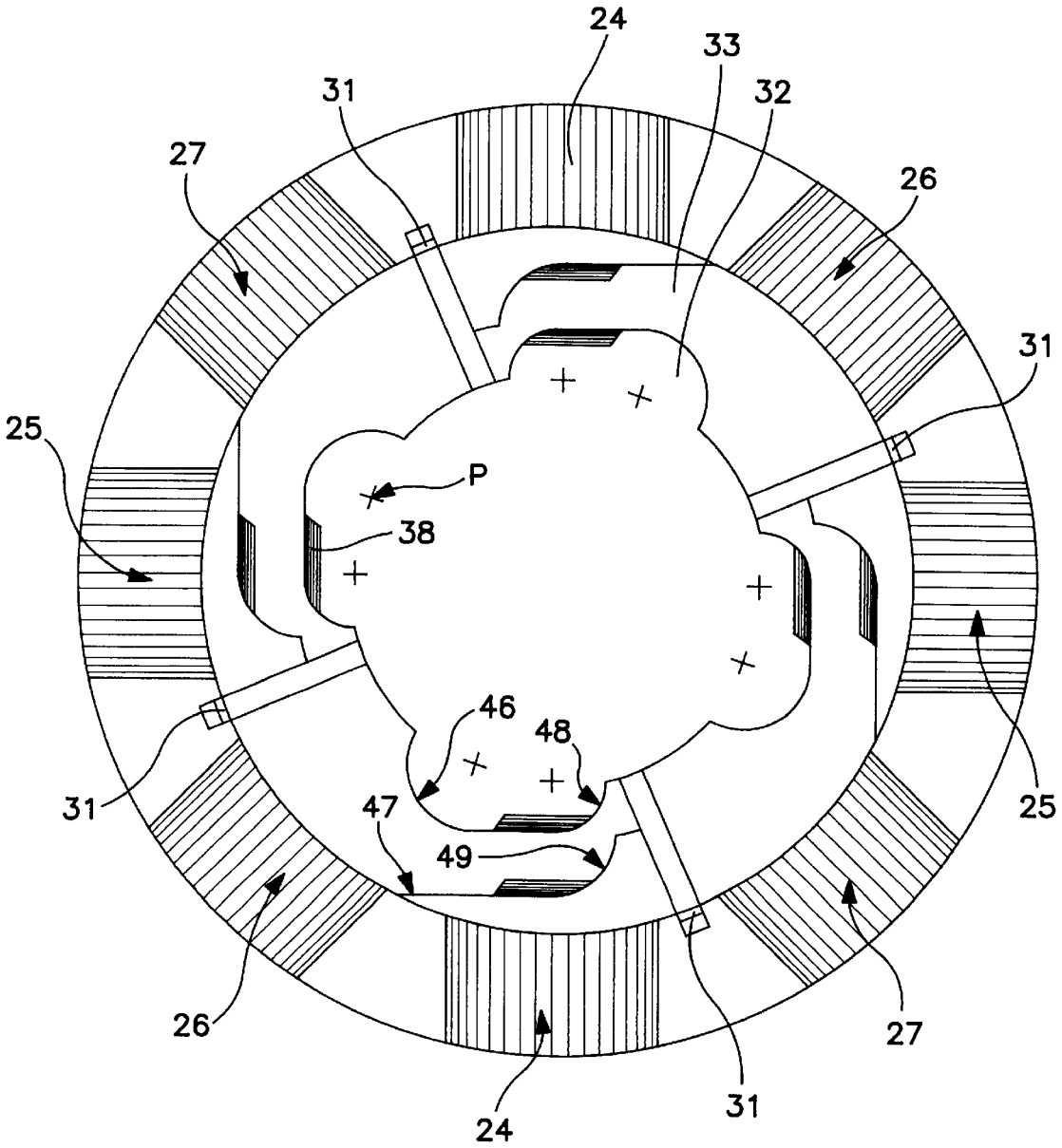
FIG. 5 is a plane view of the second spacing chock seen from the upper end of the spacing chock.
Figure 6A:
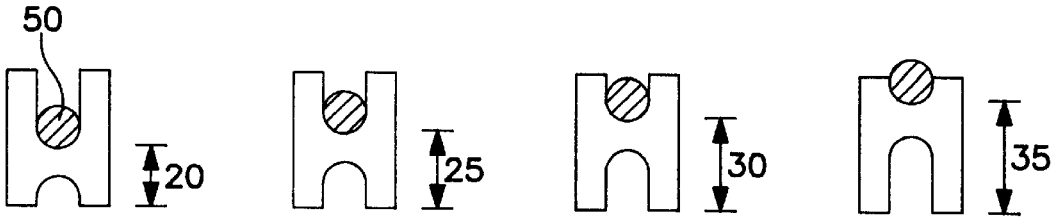
FIGS. 6A–6E show different possible combinations for placing reinforcement wires in a small or large embodiment of a first spacing chock, for placing them in the second spacing chock, and for placing them in combinations between the first and the second spacing chock.
Figure 6B:
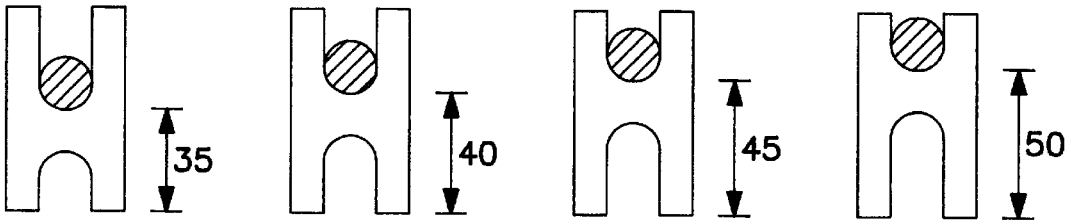
Figure 6C:
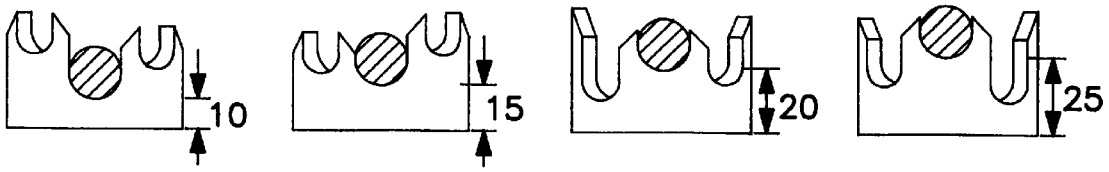
Figure 6D:
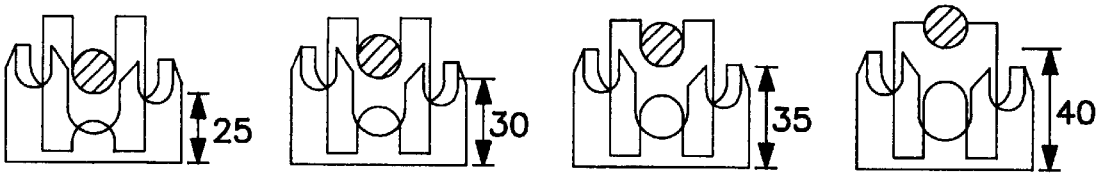
Figure 6E:
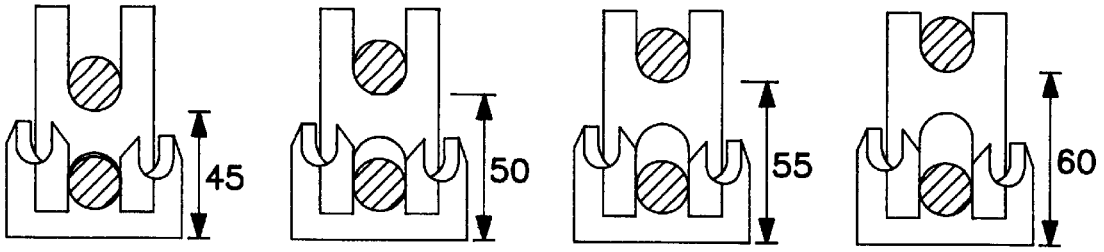

FIG. 5 illustrates the second spacing chock 21 seen from above. The support surfaces 24, 25, 26, 27 are indicated by hatching. The grooves 31 extend between the support surfaces 24, 27 and 25, 26 and, as mentioned, the catches 38 are formed along edge areas 36, 37 for the grooves 32, 33. A contour 46, 47 of the edge areas 36, 37 is designed so that it is possible to place the first spacing chock 1 in the second spacing chock 21 for mutual cooperation.

The cooperation between the second spacing chock 21 and the small or the large embodiment of the first spacing chock 1 is provided by placing the feet 3 of the columns 2 in a position P next to the part of the edge area 36, 37 in which the catches 38 are formed. The contour 46, 47 of the edge areas 36, 37 is designed so that there is made room for the feet 3 of the columns 2 to be placed in the position P. After the feet 3 of the columns 2 have been put in the position P, the first spacing chock 1 is displaced by rotation counterclockwise around an axis extending perpendicularly out from the plane of the figure. During this rotation the notches 13 in the columns 2 will gradually get into contact with the catches 38 until the first spacing chock 1 has been rotated so much that the columns 2 are in contact with curved parts 48, 49 of the contour 46, 47. In this position of the columns 2 full contact has been established between the notches 13 in the columns and the catches 38 formed along the edge areas 36, 37 of the grooves 32, 33.

FIGS. 6A–6E illustrate most of the possible levels in which the reinforcement wires may be placed for the small and the large embodiment of the first spacing chock 1, for the second spacing chock 21, and for combinations of the smaller or the larger embodiment of the first spacing chock 1 and the second spacing chock 21, respectively. By placing the reinforcement wires in the first spacing chock there is a possibility of crossed reinforcement, and by placing the reinforcement wires in combinations of the first and the second spacing chock there is a possibility of crossed reinforcement in two layers.

Embodiments are shown in which are used reinforcement wires 50 with a diameter of 14 mm and 16 mm, respectively. These measure indications are not to be understood as limitations of the applicability of spacing members according to the invention, but merely as possibly examples.

Both the small and the large embodiment of the first spacing chock provide the possibility of placing reinforcement wires in four different levels by rotating the spacing chock 90° or by turning it 180°. The smaller embodiment of the first spacing chock provides the possibility of positioning reinforcement wires with a 14 mm diameter in levels from 20 mm to 35 mm in 5 mm intervals. The large embodiment of the first spacing chock provides the possibility of positioning reinforcement wires with a 14 mm or 16 mm diameter in levels from 35 mm to 50 mm in 5 mm intervals. The second spacing chock provides the possibility of positioning reinforcement wires in levels from 10 mm to 25 mm in 5 mm intervals by rotating the spacing chock 45°.

By combining the small or the large embodiment of the first spacing chock with the second spacing chock it is possible to position reinforcement wires in even more levels, and it is also possible to position several reinforcement wires extending in the same direction or in different directions, each one in its own level.

The embodiments of a first spacing chock, of a second spacing chock and of locking clips that are illustrated in the figures are not to be understood as a limitation of the invention, since other embodiments may be provided within the scope of the claims, and since it will also be possible to provide more than two embodiments of the first spacing chock.

What is claimed is:

1. A spacing member for chocking reinforcement wires, said spacing member comprising: base means for positioning on a supporting surface; side wall means providing a plurality of pairs of opposed, generally U-shaped slots, said pairs of slots having differing heights relative to the supporting surface on which said spacing member is positioned for supporting reinforcement wires extending therethrough, said side wall means also providing a pair of opposed, inwardly open vertical grooves; and a locking clip downwardly positionable in said opposed pair of vertical grooves, said locking clip including a generally U-shaped section having a curved bottom portion and opposed legs, first flange portions which extend towards one another from ends of said opposed legs, and generally parallel second flange portions which extend from said first portions downwardly toward said curved bottom portion of said U-shaped section for securing a reinforcement wire therebetween, said opposed legs including at least one undulation for cooperation with said grooves of said side wall means to fix said locking clip in position.

2. A spacing member according to claim 1, wherein said grooves include projections for engagement with said at least one undulation of the opposed legs of said locking clip.

3. A spacing member according to claim 2, wherein said second flange portions of said locking clip include corresponding undulations for receiving a reinforcement wire therebetween.

4. A spacing member according to claim 2, wherein said base means comprises four parallel columns, and said side wall means extend between said columns to define said pairs of opposed, generally U-shaped slots between said columns.

5. A spacing member according to claim 4, including a connection means connecting said side wall means in one-piece therewith.

6. A spacing member according to claim 5, wherein said connection means includes a hole therethrough.

7. A spacing member according to claim 4, wherein said columns define opposed first and second end surfaces which enable said spacing member to be alternatively positioned on a supporting surface by all of said first end surfaces contacting said supporting surface or all of said second end surfaces contacting said supporting surface.

8. A spacing member according to claim 4, wherein said columns define outwardly-facing notches for attachment thereto of catch means of another spacing member.

9. A spacing member according to claim 1, wherein said spacing member is made of concrete.

10. A spacing member according to claim 1, wherein said base means comprises a circular plate and wherein said side wall means comprises a cylindrical sleeve which extends upwardly from said circular plate.

11. A spacing member according to claim 10, wherein said cylindrical sleeve defines recesses for receiving columns of another spacing member.

12. A spacing member according to claim 11, wherein said cylindrical sleeve defines catch means for engagement with notches in columns of another spacing member.

13. A method of making a spacing member for chocking reinforcement wires and which comprises base means for positioning on a supporting surface; side wall means providing a plurality of pairs of opposed, generally U-shaped slots, said pairs of slots having differing heights above said base means for supporting reinforcement wires extending therethrough, said side wall means also providing a pair of opposed, inwardly open vertical grooves; and a locking clip downwardly positionable in said opposed pair of vertical grooves, said locking clip including a generally U-shaped section having a curved bottom portion and opposed legs, first flange portions which extend towards one another from ends of said opposed legs, and generally parallel second flange portions which extend from said first portions downwardly toward said curved bottom portion of said U-shaped section for securing a reinforcement wire therebetween, said opposed legs including at least one undulation for cooperation with said grooves of said side wall means to fix said locking clip in position; said method comprising casting said spacing member in a closed mold, and tempering said spacing member while in said closed mold.

* * * * *